United States Patent [19]

McAllise et al.

[11] Patent Number: 5,016,316

[45] Date of Patent: May 21, 1991

[54] MOTOR FAN COVER AND SEALING ARRANGEMENT

[75] Inventors: Gregg A. McAllise, North Canton; Dean H. Buchtel, Canton, both of Ohio

[73] Assignee: The Hoover Company, North Canton, Ohio

[21] Appl. No.: 454,940

[22] Filed: Dec. 22, 1989

[51] Int. Cl.[5] ..... A47L 9/22

[52] U.S. Cl. ..... 15/412; 15/327.2; 15/327.7

[58] Field of Search ..... 15/412, 327 R, 327 F, 15/327 E

[56] References Cited

U.S. PATENT DOCUMENTS

| | | | |
|---|---|---|---|
| 2,076,699 | 4/1937 | Brown | 248/2 |
| 2,103,154 | 12/1937 | Faber | 248/26 |
| 2,340,379 | 2/1944 | Hahn | 15/412 X |
| 2,491,007 | 12/1949 | Koch | 15/412 X |
| 2,633,597 | 4/1953 | Turner | 15/412 X |
| 2,665,439 | 1/1954 | More | 15/412 X |
| 2,717,748 | 9/1955 | Martinet | 248/26 |
| 2,889,570 | 6/1959 | Duff | 15/327 E |
| 2,964,236 | 12/1960 | Kasper . | |
| 2,987,241 | 6/1961 | Lindsjo et al. | 15/412 X |
| 3,031,710 | 5/1962 | Huening | 15/410 X |
| 3,334,370 | 8/1967 | Boyd | 15/344 X |
| 3,932,911 | 1/1976 | Crooks et al. | 15/327 D |
| 4,527,302 | 7/1985 | Maurer et al. | 15/325 |

FOREIGN PATENT DOCUMENTS

| | | |
|---|---|---|
| 1165585 | 10/1958 | France . |
| 2114429 | 8/1983 | United Kingdom . |

*Primary Examiner*—Chris K. Moore

[57] ABSTRACT

A sealed motor-fan system for a cleaner is disclosed in which a two piece gasketed housing is disposed around the motor-fan system to seal it. The two piece housing forms a joint in assembled condition and the gasket is disposed in this joint.

4 Claims, 5 Drawing Sheets

MOTOR FAN COVER AND SEALING ARRANGEMENT

BACKGROUND OF THE INVENTION

1. Field of the Invention

This invention relates broadly to vacuum cleaners and, more specifically, to a motor and fan mounting arrangement in such a cleaner.

2. Summary of the Prior Act

Vacuum cleaners which place the motor-fan system on a horizontal axis to provide a lower contoured cleaner and improved air flow as compared to a vertical axis disposition of these same elements is old and well known. It is also known to provide a sealing arrangement with or without an auxiliary housing for at least the fan of the motor-fan system to insure that the cleaner air flow is properly directed through the cleaner. These housing-sealing arrangements, however, have not been designed for automatic assembly of their cleaners.

Accordingly it is an object of this invention to provide that a motor-fan system and its related components being adaptable to automatic assembly.

It is a further object of the invention to provide a motor-fan system and its related components that can be assembled vertically to aid in automation.

It is a still further object of the invention to provide a new and improved housing arrangement and sealing mechanism for a motor-fan system for a vacuum cleaner.

SUMMARY OF THE INVENTION

The invention provides a canister cleaner shell with a partitioned bag compartment behind which is a motor-fan compartment. A motor-fan system is positioned in an open cradle like ribbed structure integral with the cleaner shell in the motor-fan compartment. A resilient doughnut shaped elastomeric element is disposed around the motor portion of the motor-fan system and has two circumferential grooves. A pair of semicircular ribs in the cradle like ribbed structure is receive in these grooves to support the motor-fan system in a vibration dampening mode.

The cradle is also extended linearly to form a half housing for the motor-fan system and includes an upper boundary which provides a sealing surface for a gasket. This gasket is made of a soft rubber material and is mounted with a complementary generally semicylindrical housing which rests on the half housing formed by the cradle with the gasket in between. This gasket is glued to the complementary half housing prior to assembly of the complementary half housing to the cradle like housing for ease of assembly.

The gasket extends between and across the front of these two housings, along their sides axially of the motor-fan system and then inwardly at the termination of the fan portion of the two housings to meet with the resilient doughnut shaped elastomeric element. This, thereby completes a seal around the fan portion of the motor-fan system.

BRIEF DESCRIPTION OF THE DRAWINGS

Reference may now be had to the accompanying Drawings for a better understanding of the invention, both as to its organization and function, with the illustration being of a preferred embodiment, but being only exemplary and in which.

DETAILED DESCRIPTION OF THE INVENTION

Figure 1:
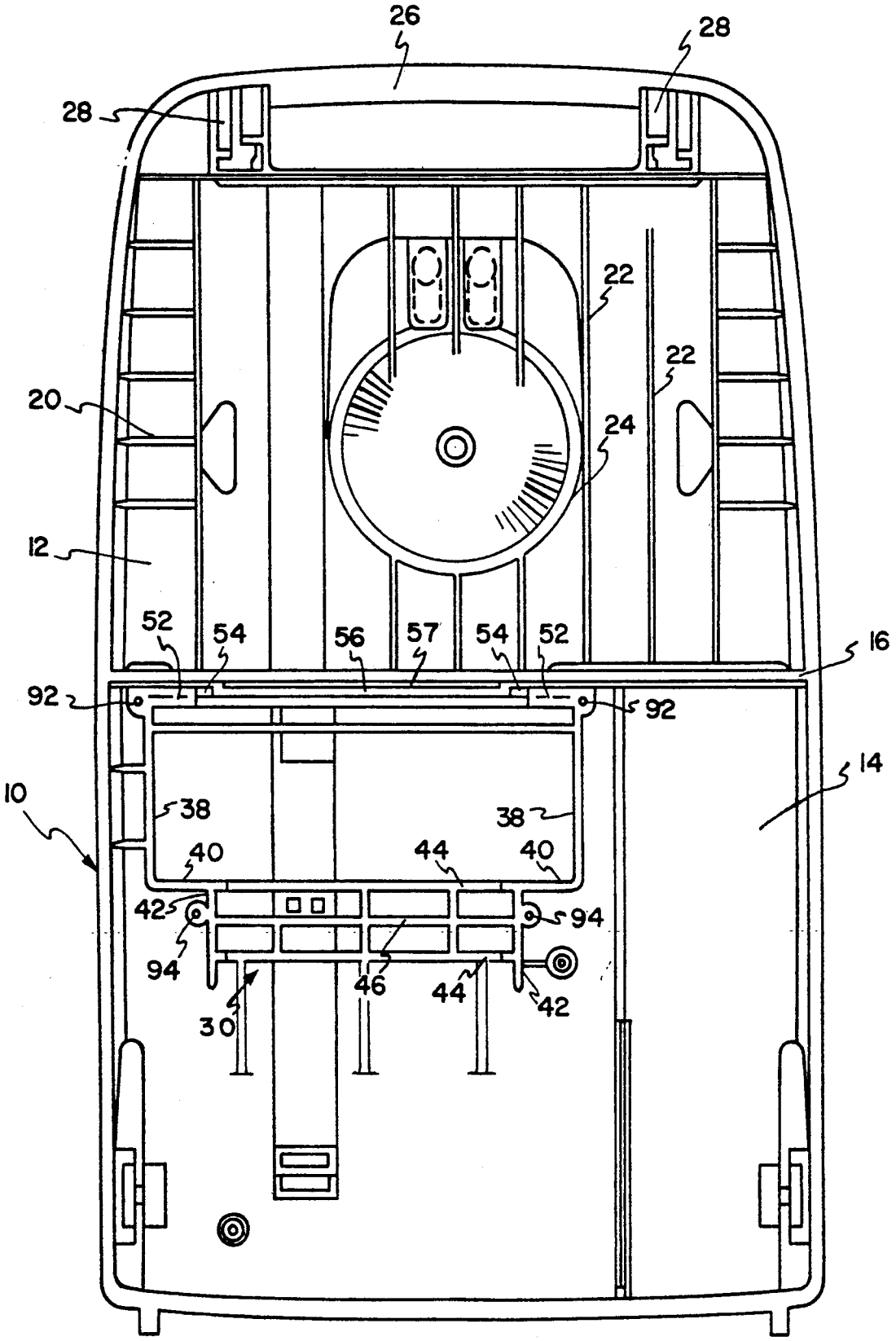
FIG. 1 is a plan view of the bottom shell of a canister cleaner which incorporates the invention with the upper half motor cover and motor-fan system removed.
Figure 2:
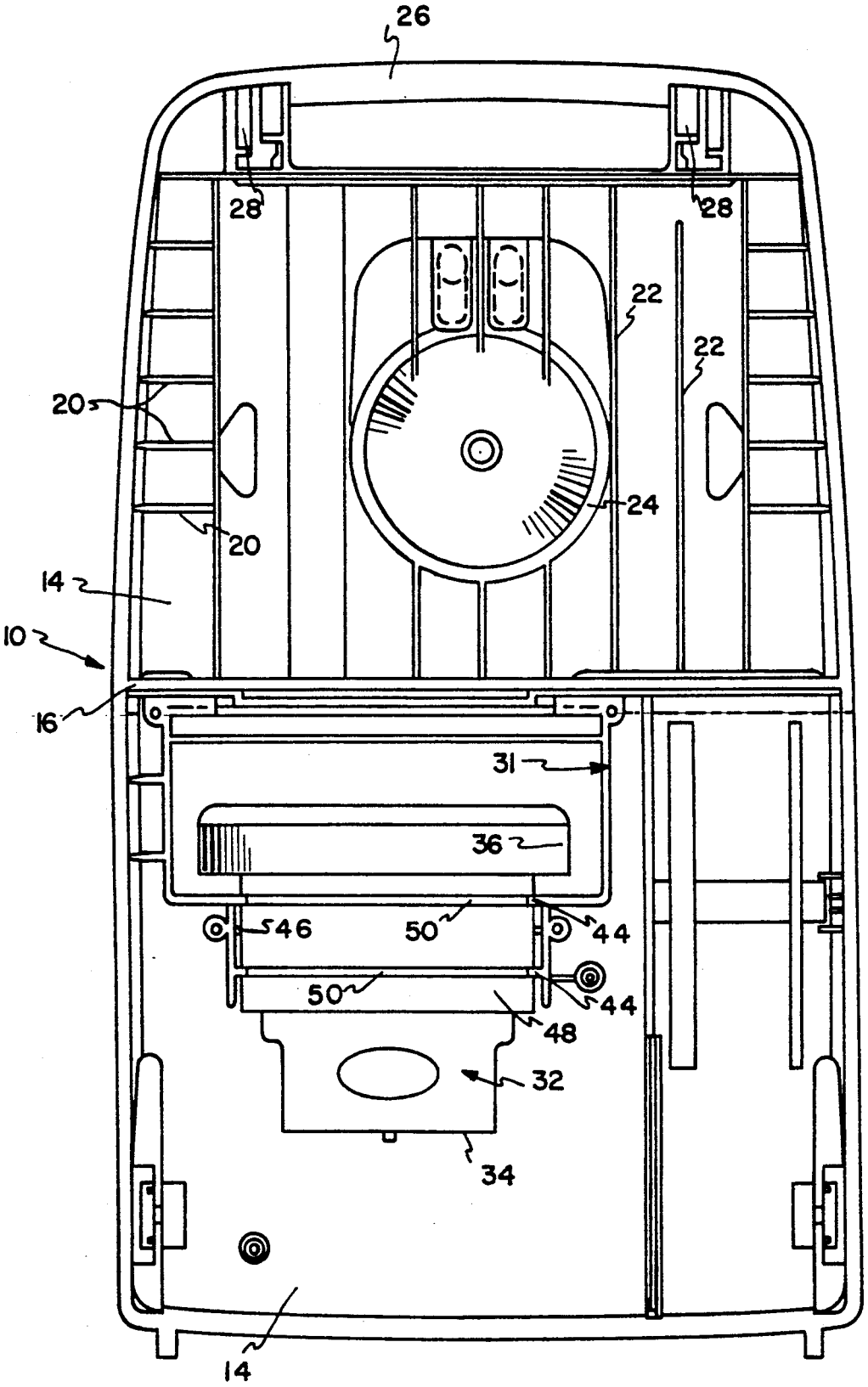
FIG. 2 is a similar plan view but with the motor-fan system mounted on the cradle arrangement of FIG. 1.
Figure 3:
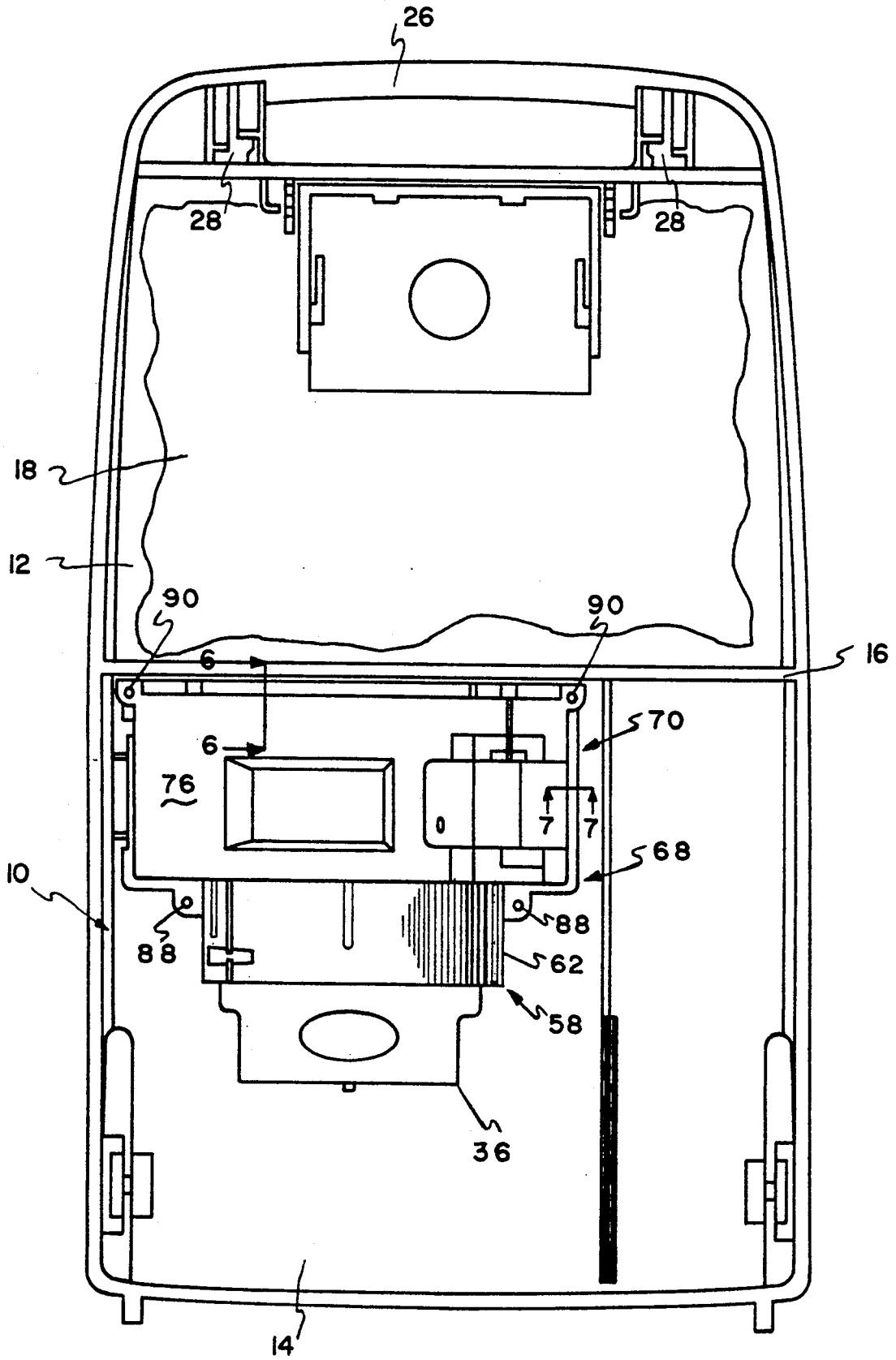
FIG. 3 is also plan view of the lower cleaner half but with the upper complementary half motor housing mounted.
Figure 4:
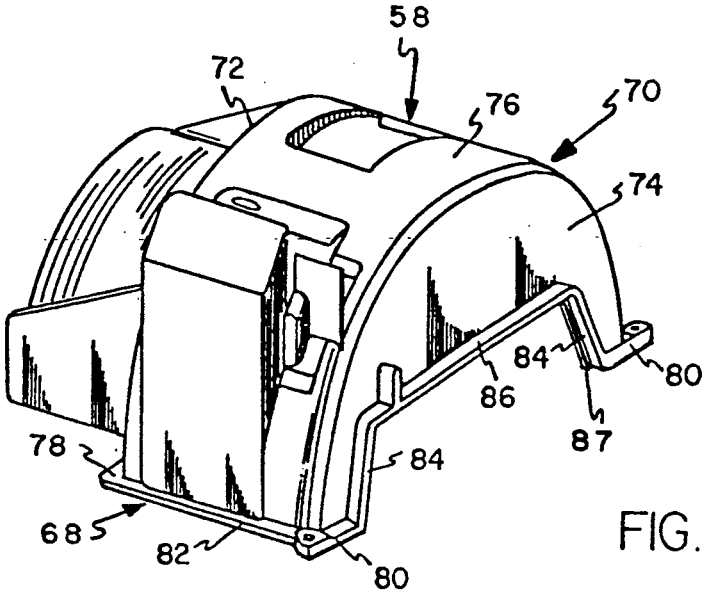
FIG. 4 is a perspective view of the upper motor housing half.
Figure 5:
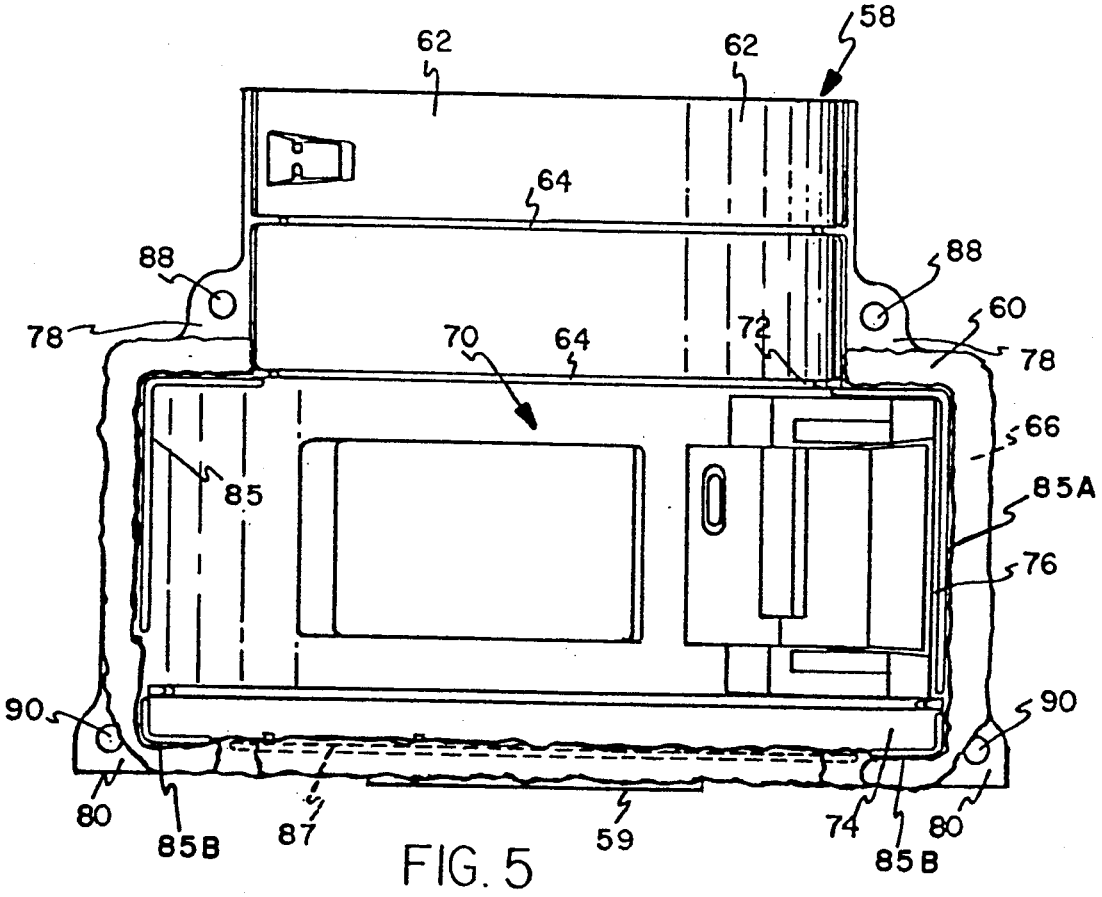
FIG. 5 is a bottom plan view of the upper motor housing half with the sealing gasket in place.
Figure 6:
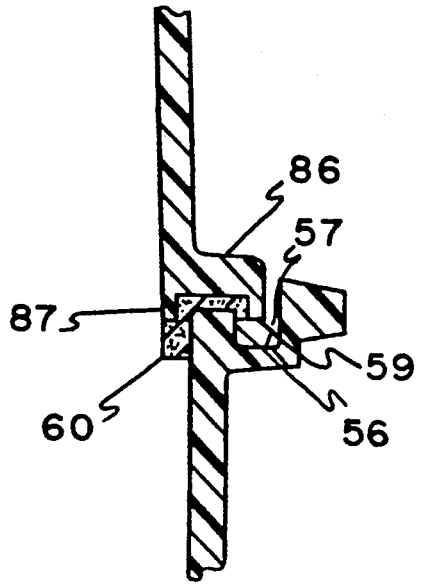
FIG. 6 is a partial cross sectional view of the motor fan system taken of line 6—6 of FIG. 3.
Figure 7:
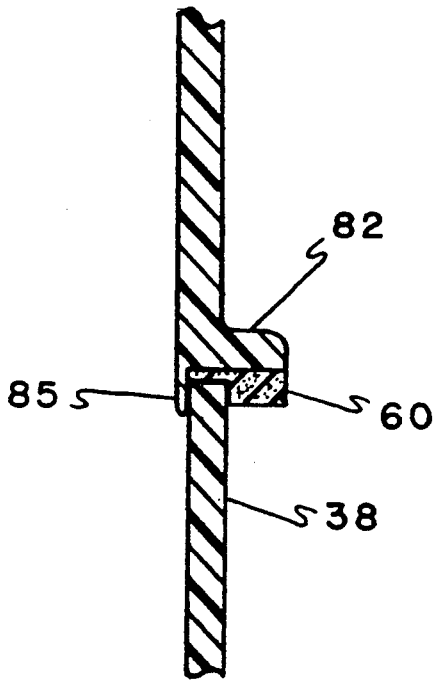
FIG. 7 is a cross sectional view of the gasket arrangement taken on line 7—7 of FIG. 3.

Referring to the Drawings, there is shown a bottom shell 10 of a canister cleaner including a bag cavity 12 and a motor-fan component 14. A partition 16 including an air bypass means (not shown) separates these two compartments.

The bag cavity 12 may house a bag 18 and include a series of ribs 20, 20 upstanding internally along the walls of the bag cavity 12 and a series of ribs 22, 22 upstanding along the bottom of the bag cavity 12 to prevent the bag 18 from sealing against the sides of the bag cavity. The bag cavity 12 may also include a caster well 24 for the mounting of a caster (not shown) beneath the shell 10. At the front portion of the bag cavity 12 the cleaner is also provided with a half handle 26 and a pair of hinge walls 28, 28 which pivotally mount the bag lid (not shown).

The motor-fan compartment has a cradle like structure 30 which mounts a motor-fan system 32 including a motor 34 and a fan 36. More specifically cradle like structure 30 forms a part of a half housing 31 for the motor-fan system 32. The half housing 31 includes axially extending vertical side walls 38, 38, adjoining transversely extending vertical side walls 40, 40 and rearwardly disposed rearwardly axially extending vertical side walls 42, 42. These side walls are integral and continuous so as to house the bottom half of the motor-fan system 32.

To mount the motor-fan system 32 within the cradle 30, a series of three semicircular ribs 44, 44 and 46 are disposed intermediate and transverse to, and adjoining to rearward and vertical side walls 42, 42. These ribs receive a conventional resilient doughnut shaped elastomeric ring 48 expansively and compressingly mounted on motor 34. Elastomeric ring 48 includes a pair of spaced grooves 50, 50 that extend partially into the thickness of the ring and are circumferential in extent. These grooves nestingly receive ribs 44, 44 of cradle 30. The ribs 44, 44 have a slightly smaller diameter than rib 46. This places the rib 46 in a butting relationship with the outer ungrooved, medial peripheral area of the elastomeric ring 48 to also support it.

The half housing 31 is completed at its front in the following manner. A pair of short, vertically and transversely extending side walls 52, 52 integrally formed with vertical side walls 38, 38 of cradle 30 and partition 16 of bottom shell 10, extend inwardly to meet a pair of short narrow slightly angled upwardly vertical walls 54, 54. These walls are displaced downwardly relative to the top surface of partition 16. Between these walls is disposed a narrow cross wall 56, also spaced downwardly from the top surface of partition 16, with both the short angled walls 54, 54 and the narrow cross wall 56 essentially formed in partition 16. An inset 57 is formed between cross wall 56 and partition 16 to receive a short, vertically extending lip 59 which will be described in more detail later. The cross wall 56 is continued at the same level at its opposite side to serve as a locating and abutting means for a gasket or the like (not shown in FIG. 1) utilized to seal the bottom shell 10 and a top piece (not shown) to be utilized with it.

To complete the enclosure of the motor-fan system 32 an upper housing half 58 and a gasket 60 are included in the structure. The upper housing half 58 has at its rearward end a first semi-cylindrical section 62 which fits over elastomeric ring 48 in a compressing manner. The section 62 has a pair of short radially inwardly directed semi-cylindrical ribs 64, 64 which mate in the grooves 50, 50 to locate the upper housing half 58 relative to the positioning of elastomeric ring 48 and the half housing 31.

A surface 66 on which gasket 60 is adhesively attached to upper housing half 58 is formed by a flange 68 that extends generally around the sides and the ends of a second semi-cylinder portion 70 of upper housing half 58. It is integrally attached to first semi-cylinder portion 62 of this same housing. The second semi-cylindrical portion 70 is larger than the first semi-cylindrical portion 62 and disposed forwardly of it and includes a back wall 72; a forward wall 74 and a generally semi-cylindrical wall 76 disposed therebetween.

The flange 68 is partly formed by horizontally extending integral flange segments 78, 78 at the downward termination of back wall 72 of semi-cylindrical portion 70 of upper housing half 58, horizontally extending integral flange segments 80, 80 at the downward temination of forward wall 74 of semi-cylindrical portion 70 and horizontally extending integral flange segments 82, 82 at the downward terminations of semi-cylindrical wall 76. These segments are joined at their corners to form a continuous flange portion therebetween. The flange 68 is completed by generally angularly vertically extending flange segments 84, 84 at the forward wall 74 of semi-cylindrical portion 70, with these segments joined by a horizontally extending intermediate segment 86, the forward wall 74 being stepped upwardly in this area to permit unobstructed passage of air from the bag cavity 12 to the motor-fan system 32 and to accommodate cross wall 56.

The flange 68 is bordered by a pair of inwardly disposed downwardly extending narrow strengthening ribs 85, 85A disposed at opposite sides of the upper housing half. These ribs are each disposed generally along flange segments 78 and 82 at their internal borders and are continuous to close to the corners formed flange segments 80 and 82 where strengthening ribs 85B, 85B are formed. At the forward wall 74 of semi-cylindrical portion 70, a strengthening rib 87 is disposed to extend generally along flange segments 84, 84 and 86, with this rib being formed intermediate the width of the flange segments 84, 84 and 86.

The gasket 60 is disposed to adhesively lie entirely over the flange 68 so that it sealingly confronts the upper termination of the cradle 30 by means of its sidewalls 38, 38, 40, 40, 52, 52, its short angled walls 54, 54 and its cross wall 56. This seals the upper housing half 58 to the cradle 31 except for the area sealed by the elastomeric ring 48, with the gasket 60 extending to this ring along the side walls 40, 40 to eliminate leakage in its vicinity.

The assembly of the upper housing half 58, lower half housing 31 and cradle 30 is completed by being removably attached to one another through threaded fasteners (not shown) extending through apertures 88, 88, 90, 90 disposed on lugs integral with upper housing half 58, with the threaded fasteners then passing into small receiving bores 92, 92, 94, 94 formed integrally in cradle 30.

The forward wall 74 of upper housing half 58 is also attached to the partition 16 by the lip 59 extending into the inset 57 and the rib 87 abutting against the cross wall 56 at its rearward side so that the gasket 60 is received over wall 56 in a tortuous and interleaved manner.

It should now be clear from the foregoing discription that the advantages set out for the invention have been fully achieved and, further, that many modifications could obviously be made to it which would still fall within the spirit and purview of the description offered.

What is claimed is:

1. A housing arrangement for a motor-fan system in a cleaner shell including;

(a) a partial housing having vertically upstanding walls and positioned in said cleaner shell, (b) a supplementary housing disposed over said partial housing, and having generally vertically extending walls, (c) a motor-fan system mounted on said partial housing and positioned between it and said supplementary housing, (d) a gasket extending along and between said vertical walls to provide at least partial sealing for said motor-fan system, (e) a resilient sealing ring disposed around said motor-fan system, (f) said resilient sealing ring received between said partial housing and said supplementary housing and said motor-fan system in sealing relation, and (g) said gasket extending between said walls of said partial housing and said supplementary housing to said resilient sealing ring to aid in sealing said motor-fan system.

2. A housing arrangement for a motor-fan system in a cleaner shell including;

(a) a partial housing having vertically upstanding walls and positioned in said cleaner shell, (b) a supplementary housing disposed over said partial housing, and having generally vertically extending walls, (c) a motor-fan system mounted on said partial housing and positioned between it and said supplementary housing, (d) a gasket extending along and between said vertical walls to provide at least partial sealing for said motor-fan system, (e) said cleaner shell including a bag compartment, (f) a partition disposed between said bag compartment and said motor-fan, and (g) said gasket abuttingly providing a seal between said supplementary housing and said partition.

3. A housing arrangement for a motor-fan system in a cleaner shell including;

(a) a partial housing having vertically upstanding walls and positioned in said cleaner shell, (b) a supplementary housing disposed over said partial housing, and having generally vertically extending walls, (c) a motor-fan system mounted on said partial housing and positioned between it and said supplementary housing, (d) a gasket extending along and between said vertical walls to provide at least partial sealing for said motor-fan system, (e) said housing arrangement being enlarged at the fan section of said motor-fan system as compared to the motor section, (f) said gasket extending between said housings at said fan section, and (g) said gasket extending inwardly relative to an axis of the fan section of the motor-fan system towards said motor section.

4. A housing arrangement for a motor-fan system in a cleaner shell including;

(a) a partial housing having vertically upstanding walls and positioned in said cleaner shell, (b) a supplementary housing disposed over said partial housing, and having generally vertically extending walls, (c) a motor-fan system mounted on said partial housing and positioned between it and said supplementary housing, (d) a gasket extending along and between said vertical walls to provide at least partial sealing for said motor-fan system, (e) said supplementary housing including a front wall which terminates at a level above its side walls, and (f) said gasket extending along said front wall including said level above said side walls whereby sealing of said housing arrangement is occasioned at its front.

* * * * *